US007150454B2

(12) United States Patent
Honegger

(10) Patent No.: US 7,150,454 B2
(45) Date of Patent: Dec. 19, 2006

(54) METHOD OF CONVEYING FLAT, FLEXIBLE PRODUCTS AND APPARATUS FOR IMPLEMENTING THE METHOD

(75) Inventor: Werner Honegger, Bach (CH)

(73) Assignee: Ferag AG, Hinwil (CH)

( * ) Notice: Subject to any disclaimer, the term of this patent is extended or adjusted under 35 U.S.C. 154(b) by 280 days.

(21) Appl. No.: 10/435,890

(22) Filed: May 12, 2003

(65) Prior Publication Data

US 2003/0218296 A1 Nov. 27, 2003

(30) Foreign Application Priority Data

May 22, 2002 (CH) ..... 0847/02

(51) Int. Cl.
*B65H 5/12* (2006.01)

(52) U.S. Cl. ..... 271/204; 271/82; 271/69; 198/470.1

(58) Field of Classification Search ..... 271/204, 271/182, 183, 268, 82, 107, 151, 69; 156/556; 198/470.1, 474.1, 867.05, 803.07, 418.9, 198/460.3, 462.1
See application file for complete search history.

(56) References Cited

U.S. PATENT DOCUMENTS 5,042,792 A 8/1991 Honegger et al. ..... 271/188
5,398,920 A * 3/1995 Leu ..... 271/3.07
5,419,678 A * 5/1995 Erb ..... 414/797
5,425,837 A 6/1995 Hansch ..... 156/556
5,688,058 A 11/1997 Honegger ..... 400/82
6,003,854 A 12/1999 Keller ..... 271/3.01
6,182,960 B1 2/2001 Keller et al. ..... 271/82

* cited by examiner

*Primary Examiner*—Gene O. Crawford
*Assistant Examiner*—Kaitlin Joerger
(74) *Attorney, Agent, or Firm*—Brinks Hofer Gilson & Lione

(57) ABSTRACT

The invention relates to a method of conveying flat, flexible products, in particular printed products, in which the products are conveyed continuously by means of a conveying device in an overlapping formation to a transfer region and are picked up there by an outward conveyor. The outward conveyor comprises grippers which are moved along a movement path, can be controlled individually to open and close and have at least two gripper jaws, whose alignment relative to the movement path can be varied. According to the invention, the grippers are moved in such a way that the gripper jaw facing the conveying device engages in the manner of a shovel underneath the trailing edge of at least one product resting partly on the trailing product in the transfer region, without said product having previously been raised off the trailing product, and then raises said product. The products, before or after being engaged underneath, are braked relative to trailing products and/or fixed in their position. The invention also relates to an apparatus for implementing the method.

9 Claims, 2 Drawing Sheets

METHOD OF CONVEYING FLAT, FLEXIBLE PRODUCTS AND APPARATUS FOR IMPLEMENTING THE METHOD

FIELD OF THE INVENTION

The invention relates to a method of conveying flat, flexible products and an apparatus for implementing the method.

BACKGROUND OF THE INVENTION

A method of the generic type and an apparatus of the generic type are disclosed by U.S. Pat. No. 5,042,792. In this case, printed products are conveyed in an overlapping formation, in which the products cover one another entirely or partially as viewed in the conveying direction. In the case of partial overlap, the trailing edges of the products cover the respective trailing product. In order to be picked up by a gripper conveyor, the products are conveyed with their edges against a stop and the respective topmost printed product present at the stop is at least partly curved upward or raised off the printed product lying underneath or the conveying device by using a curving device. As a result, the preconditions are created in which the grippers, whose physical position relative to the pulling member cannot be changed, can grip the printed products individually and convey them away. The disadvantage here is the relatively high expenditure on construction, the mechanical loading of the products and the lack of flexibility of the known apparatus. For example, it is not possible to transfer a plurality of products in a controlled manner to a single gripper.

These disadvantages are also possessed by other methods known from the prior art, for example in Canada Patent No. 2,309,239. These include, as an additional step, the formation of an intermediate stack, which is broken down by the products being raised individually off the intermediate stack by a separating element, for example a sucker, and being transferred to grippers whose orientation cannot be changed, belonging to an outward conveyor.

SUMMARY OF THE INVENTION

The invention is therefore based on the object of developing a method and an apparatus of the type cited at the beginning further in such a way that products arriving in an overlapping formation can be picked up by grippers of an outward conveying device, individually or in stacks, carefully and with little technical expenditure.

Starting from a method of the type cited at the beginning, according to the invention grippers are used which are constructed in such a way that they can both be transferred individually between an open position and a clamping position and their alignment relative to their movement path can also be varied. Examples of such grippers are described in U.S. Pat. No. 5,395,151. The gripper illustrated there has two gripper jaws, which can be pivoted relative to each other to open and close. The entire gripper can additionally be pivoted about an axis running parallel to the pivot axis of the gripper jaws, so that the direction of the gripper mouth relative to the movement path can be varied. The movements are brought about, for example, by means of slotted guide control systems.

According to the invention, in the transfer region, the grippers are moved in such a way that the gripper jaw facing the conveying device engages in the manner of a shovel underneath the trailing edge of at least one product resting partly on the trailing product. For this purpose, either the movement path is constructed in such a way that the gripper carries out the movement described relative to the product to be picked up. Alternatively or additionally, the mobility of the grippers relative to their movement path is specifically used to engage in a controlled manner underneath a product to be picked up, to grip it and to pick it up from the incoming overlapping formation. In this case, according to the invention the gripping under action is carried out without the product to be picked up previously having been raised off the trailing printed product. According to the invention, therefore, it is possible to dispense with aids such as a curving device or separating elements. In order to prevent the products to be picked up sliding out of the still open gripper, the products are braked relative to trailing products before or after the gripping under action. The braking device preferably used is a stationary or concomitantly moved stop or a suction device which is fitted in the delivery plane. This has the additional advantage that the time at which the grippers close and the relative speed of the lower gripper jaw in relation to the product to be picked up have to be set only within certain tolerances.

Since the gripper movement can be implemented purely mechanically by means of a suitable slotted guide control system, the expenditure on control is also low.

The apparatus according to the invention can be implemented with little expenditure on construction and in an extremely space-saving manner. In particular, it is not necessary to guide the grippers on the gripper conveyor over a relatively long distance parallel to the conveying device or to the products to be picked up, as was previously usual. The movement path of the grippers can in particular be implemented in sharply curved fashion, even in the transfer region, since the alignment of the grippers in relation to the product to be picked up can be set by means of a suitable positional change relative to the movement path in the sense of the invention. Furthermore, according to the invention, a step for forming an intermediate stack is dispensed with. Variations in the spacing of two products can be compensated for by the braking device.

In an advantageous development of the invention, the grippers are moved relative to the incoming products in such a way that they each pick up a plurality of products, which are preferably braked by a stop. In addition, provision can be made for a plurality of products to be conveyed by the conveying device in what are known as minilayers offset in overlapping fashion with respect to one another and gripped jointly. The products picked up jointly can then advantageously be fed jointly to a further processing station, for example a cutting device, so that an additional collecting step can be omitted.

BRIEF DESCRIPTION OF THE DRAWINGS

Examples of the invention are illustrated in the drawings and described below. In the drawings, purely schematically.

DESCRIPTION OF THE PREFERRED EMBODIMENT

Figure 3:
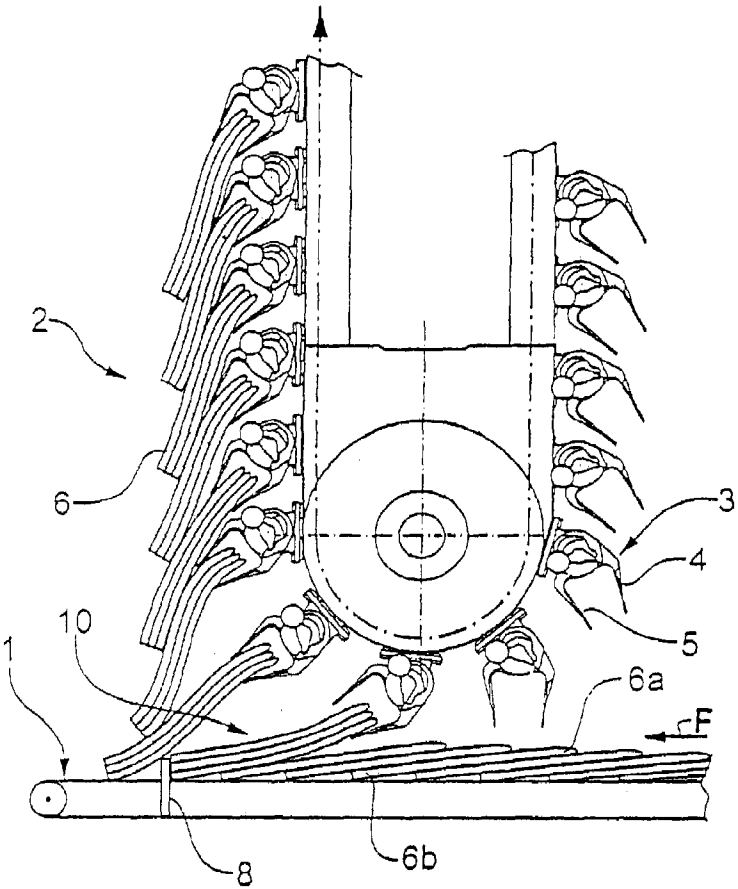
FIG. 3 shows a side view of an apparatus according to the invention.
Figure 1:
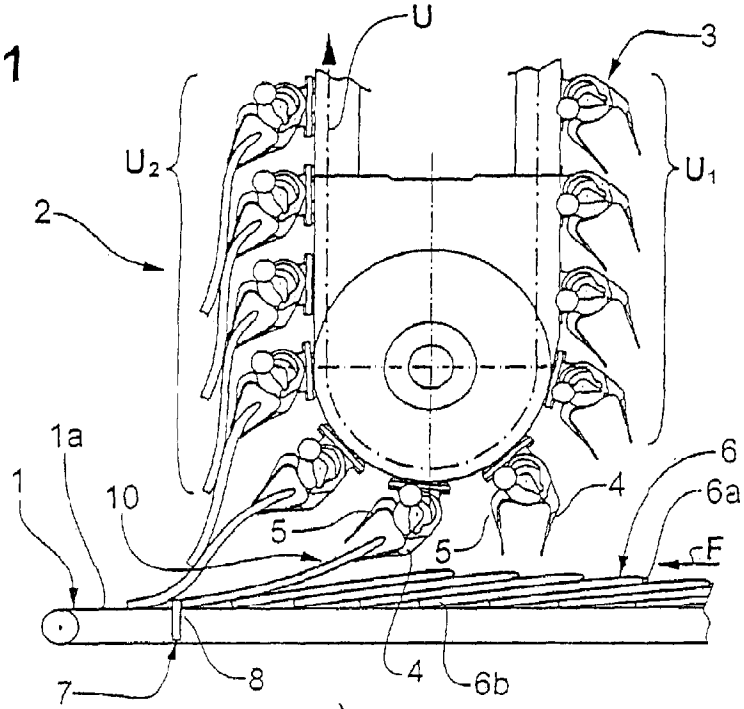
FIG. 1 shows a side view of an apparatus according to the invention with a stop as braking device.
Figure 4A:
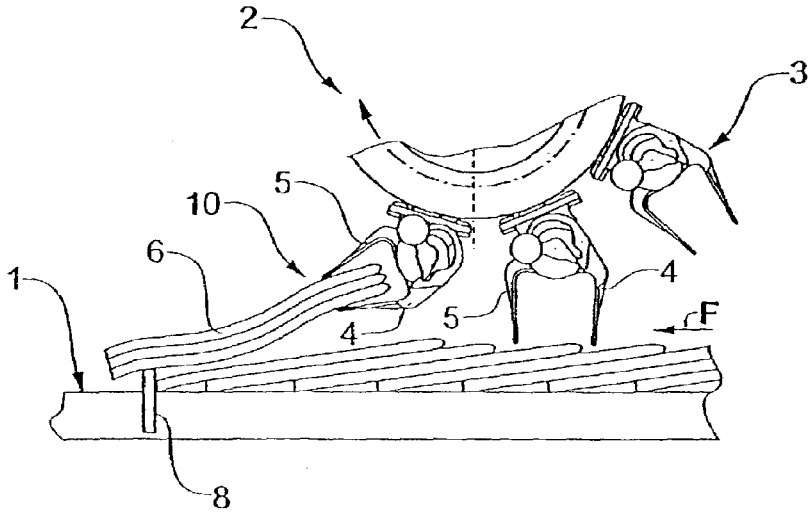
FIGS. 4*a–c* show the transfer region in the case of an apparatus according to the invention in various snapshots during the implementation of the method according to the invention.
Figure 4B:
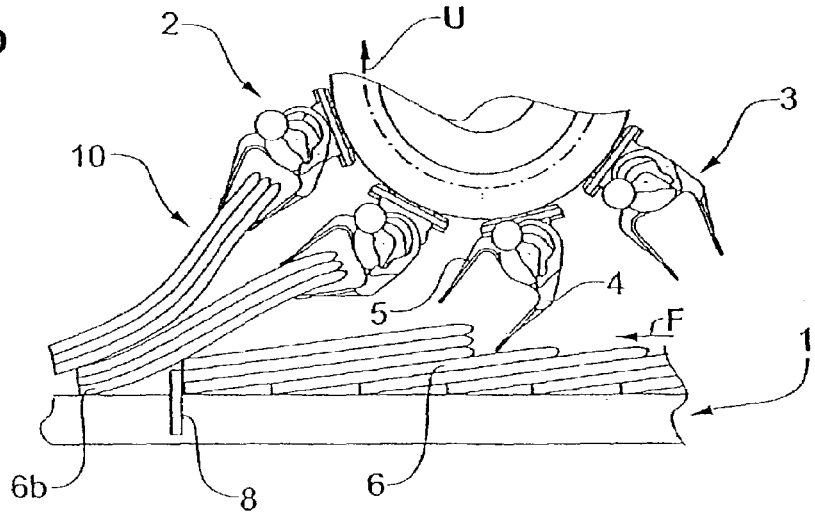
Figure 4C:
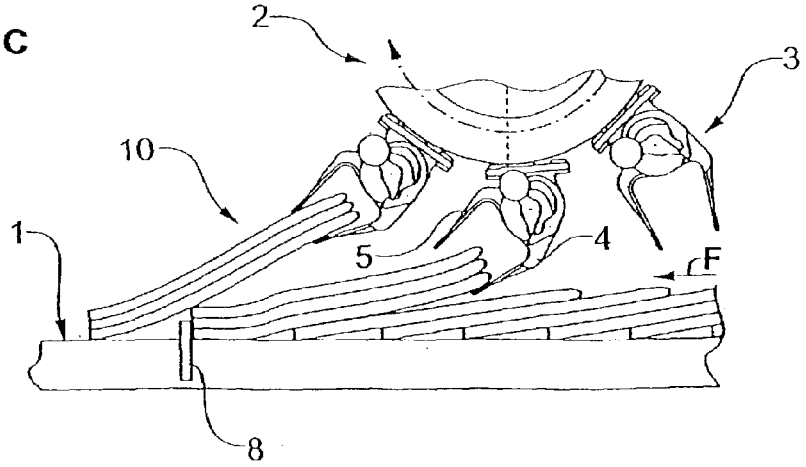

FIGS. 1 and 3 show an apparatus according to the invention, comprising a conveying device 1 and an outward conveyor 2, by whose grippers 3 in each case one (FIG. 1) or in each case three products 6 (FIG. 3) are picked up. Snapshots of the transfer region 10 for the case from FIG. 3 are illustrated in FIGS. 4*a–c*.

The conveying device 1 is constructed as a belt conveyor, on whose conveying belt 1*a* a plurality of products 6, here folded printed products, are conveyed in the conveying direction F. The products 6 arrive in an overlapping formation, in which the trailing edge 6*a* of each product 6 rests on the trailing product, so that the latter is partly overlapped. It is also possible for the products 6 to arrive in a double or multiple overlapping formation, in which in each case a plurality of products overlap one another largely congruently, and the minilayers formed in this way are arranged offset in an overlapping manner.

The outward conveyor 2 comprises a plurality of grippers 3 moved along a movement path U. The grippers 3 have two gripper jaws 4, 5, which can be pivoted relative to each other about a pivot axis running at right angles to the plane of the drawing in order to open and close. The individual closing of the grippers 3 is brought about by a slotted guide control system, not illustrated here. In addition, the grippers 3 as a whole can be pivoted about an axis running at right angles to the plane of the drawing. The orientation of the grippers 3 and, in particular, the direction of the opened or closed gripper mouth relative to the movement path U can be varied individually as a function of their position within the movement path U. In the present case, the gripper jaws 4, 5 in a first part U1 of the movement path U are aligned in such a way that the gripper mouth points in the direction of movement. In the transfer region 10, here for example the semicircular part of the movement path U, the grippers 3 approach the conveying device 1 as closely as possible, in order finally to pick up a product 6. There, the movement path U is curved in such a way and/or the grippers are moved relative thereto in such a way that the gripper jaw 4 facing the conveying device 1 engages underneath a product 6 (FIGS. 4*a–c*). During and/or after the closure of the gripper 3, the entire gripper 3 is pivoted, so that in a second part U2 of the movement path U, the gripper mouth, now closed, is aligned in the direction opposite to the direction of movement of the grippers 3. This movement of the grippers 3 is also implemented by means of a suitable slotted guide control system, preferably the slotted guide control system already used for opening and closing the grippers.

According to the invention, the grippers are moved along the movement path U in such a way that the product 6 to be picked up is engaged underneath in the manner of a shovel by the gripper jaw 4. As a result of the gripper 3 moving along the movement path U and/or relative thereto, the product 6 which is engaged underneath is raised off the trailing products. The gripper 3 can be closed before, during or after the raising action. The braking device 7, which here is designed as a stop 8, prevents the product 6 engaged underneath from being pushed in the conveying direction F and sliding out of the gripper before it is gripped by the latter in a clamping manner. By means of the braking device 7, the product 6 which is engaged underneath is braked relative to the trailing products or at least relative to the gripper 3 that picks it up.

The gripper 3 is preferably moved in such a way that the gripper jaw that engages underneath the product makes a movement like a circular arc relative to the product 6. The gripper jaw 4 is particularly preferably aligned tangentially with respect to the product 6 when it engages underneath. The relative movement in the shape of a circular arc can be implemented, as in the present case, by means of a movement path U of the grippers 3 in the shape of a circular arc in the transfer region 10. Alternatively or additionally, the shovel-like movement can also be implemented by means of an appropriate movement of the grippers 3 relative to the movement path U by means of a suitable control system.

As shown in particular in FIGS. 4*a–c*, the gripper 3 is moved relative to the product 6 to be picked up in such a way that the gripper jaw 4 that engages underneath pivots from a first alignment, in which it assumes an angle of 60° to 120°, preferably about 90°, to the plane of the product 6 (for example the central gripper in FIG. 4*a*), into a second alignment substantially in the plane of the product (for example left-hand gripper in FIG. 4*b*). In the course of the further movement after the product or products have been gripped completely, the gripper is preferably pivoted in the direction opposite to its direction of movement along the movement path U. This has the advantage that the non-gripped end 6*b* of the products 6 can virtually remain in place during the movement of the gripper along the curved part of the movement path U, and is not subjected to any high accelerations or high forces. A further advantage is that the grippers 3, as in the present example, can be brought close to the conveying device 1 vertically from above (first part U1 of the movement path) and led away vertically upward again in the closed state (second part U2 of the movement path).

Figure 2:
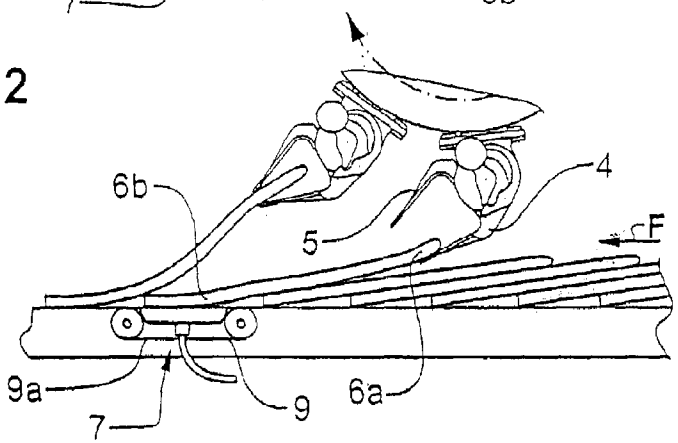
FIG. 2 shows a detail view of an apparatus according to the invention with a suction device as braking device.

FIG. 2 shows a detail from an apparatus according to the invention, in which the braking device 7 used is a suction device 7 having a conveyor belt 9*a*. The leading edge 6*b* of a product 6 to be picked up is pushed onto the conveyor belt 9*a* by the conveying device 1 and fixed there by means of vacuum. Depending on the speed of the conveyor belt 9*a* relative to that of the conveying device 1, the product 6 to be transferred is braked relative to the following products or at least fixed physically in such a way that it cannot slip away in the conveying direction F as the gripper 3 engages underneath it. In the clamping position, the gripper 3 can finally draw the product off the suction device 9.

In the exemplary embodiment of FIG. 3, a gripper in each case picks up three products 6, which are pushed over one another at a stop 8 to form a minilayer. In this case, the speed of the grippers is coordinated with the conveying speed of the conveying device 1, the product size and the product offset in such a way that in each case three products run onto the stop 8 before the incoming gripper engages underneath the lowest of them. It is also possible for the lowest product of the minilayer to be engaged underneath even before it strikes the stop 8 and for the gripper 3 to push the three products 6 to be picked up against the stop, to align them in this way and then to grip them.

The invention claimed is:

1. A method of conveying flat, flexible products, such as printed products, comprising the steps of:

conveying the products continuously, in a generally horizontal plane into a transfer region, in a formation in which the products overlap one another at least partially as viewed in the conveying direction, with the trailing edges of the leading products overlapping leading edges of the respective trailing products in the case where there is a partial overlap;

providing a gripper conveyor including a plurality of grippers movable along a movement path which passes through said transfer region, each of said grippers including a first gripper jaw and a second gripper jaw;

moving the gripper conveyor whereby the grippers are moved in such a way that one of the gripper jaws engages in the manner of a shovel underneath the trailing edge of at least one product while said trailing edge is resting on the trailing product in the transfer region and then raises said one product off of said trailing product; and before or while said trailing edge of the at least one product is being engaged underneath, braking or otherwise stopping the product being raised relative to trailing products.

2. The method as claimed in claim 1, wherein the grippers are moved in the transfer region in such a way that the one gripper jaw is moved relative to the at least one product to be picked up along a path which is substantially shaped like a circular arc.

3. The method as claimed in claims 1 or 2, wherein the gripper is moved relative to the at least one product to be picked up in such a way that the gripper jaw which engages underneath is pivoted from a first alignment into a second alignment substantially in the plane of the product.

4. The method as claimed in claims 1 or 2, wherein the products are conveyed to a braking device and are braked as a result.

5. The method as claimed in claim 4, wherein the speed of the grippers is chosen to be matched to the conveying speed of the conveying device in such a way that a predetermined number of products are pushed onto a stop to form a stack, which is gripped as a whole by the gripper.

6. The method as claimed in claims 1 or 2, wherein the movement path in a first portion arranged upstream of the transfer region, and in a second portion arranged downstream of the transfer region, runs substantially at right angles to the convoying direction.

7. The method as claimed in claim 3, wherein the movement path in a first portion arranged upstream of the transfer region, and in a second portion arranged downstream of the transfer region, runs substantially at right angles to the conveying direction.

8. The method as claimed in claim 4, wherein the movement path in a first portion arranged upstream of the transfer region, and in a second portion arranged downstream of the transfer region, runs substantially at right angles to the conveying direction.

9. The method as claimed in claim 5, wherein the movement path in a first portion arranged upstream of the transfer region, and in a second portion arranged downstream of the transfer region, runs substantially at right angles to the conveying direction.

* * * * *